United States Patent [19]

Mitchell

[11] Patent Number: 4,481,099

[45] **Date of Patent: * Nov. 6, 1984**

[54] SOLVENT EXTRACTION METHOD

[75] Inventor: David S. Mitchell, San Rafael, Calif.

[73] Assignee: Chevron Research Company, San Francisco, Calif.

[ * ] Notice: The portion of the term of this patent subsequent to Feb. 19, 1997 has been disclaimed.

[21] Appl. No.: 79,121

[22] Filed: Sep. 26, 1979

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 2,965,557 | 12/1960 | Price | 208/11 LE |
| 3,131,141 | 4/1964 | West | 208/11 LE |
| 3,475,318 | 10/1969 | Gable et al. | 208/11 LE |
| 3,617,464 | 11/1971 | Johnson | 208/8 LE |
| 3,875,046 | 4/1975 | Rosenbloom | 208/11 LE |
| 4,189,376 | 2/1980 | Mitchell | 208/11 LE |

*Primary Examiner*—Charles F. Warren
*Assistant Examiner*—Joseph A. Boska
*Attorney, Agent, or Firm*—D. A. Newell; W. D. Reese; Q. T. Dickinson

[57] ABSTRACT

A method is disclosed for solvent-extracting an extractable component from a mixture including the extractable component and subdivided solids, comprising:

(a) maintaining a vertically extending bed comprising said solids in a vertically extending extraction zone and introducing said mixture into an upper portion of said bed;

(b) providing a substantially continuous gaseous phase in contact with a lower portion of said bed;

(c) maintaining a substantially continuous liquid phase comprising a vaporizable liquid solvent in contact with at least a lower part of an upper portion of said bed;

(d) introducing said solvent into said liquid phase at at least two vertically spaced levels of said liquid phase;

(e) extracting said extractable component from said mixture with said solvent;

(f) withdrawing said solvent and said extractable component from said liquid phase between said two vertically spaced levels;

(g) preventing said liquid phase from flowing downwardly through said lower portion of said bed by maintaining said gaseous phase at a pressure sufficient to support said liquid phase thereon and vaporizing solvent adhering to solids in said lower portion of said bed; and (h) withdrawing solids from said lower portion of said bed.

8 Claims, 1 Drawing Figure

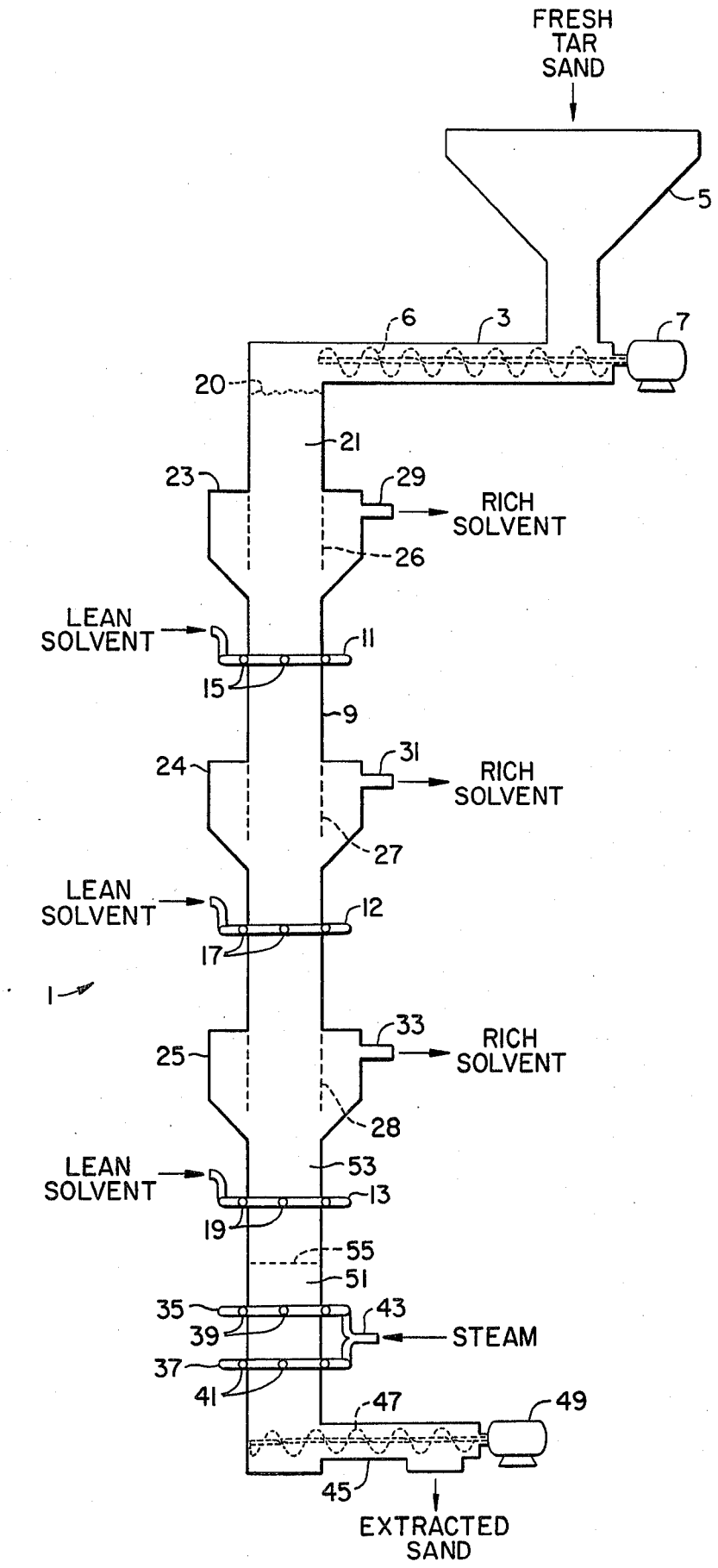
FRESH
TAR
SAND
5
6
3
7
20
21
23
29
RICH
SOLVENT
26
LEAN
SOLVENT
11
15
9
24
31
RICH
SOLVENT
27
LEAN
SOLVENT
12
17
1
25
33
RICH
SOLVENT
28
LEAN
SOLVENT
53
13
19
55
51
35
43
39
STEAM
37
41
47
49
45
EXTRACTED
SAND

SOLVENT EXTRACTION METHOD

BACKGROUND OF THE INVENTION

The present invention relates to a process for solvent extraction of solvent-extractable materials from a mixture including subdivided solids.

A variety of solvent-extractable materials are recovered from admixture with subdivided solids by solvent-extraction processes. For example, hydrocarbons and hydrocarbonaceous oils may be recovered from association with hydrocarbon-containing solids such as tar sands, oil shale and the like, and can be used as a substitute or supplement for petroleum and petroleum derivatives. One key factor in solvent extraction of large amounts of hydrocarbons from solids is the economical recovery of solvent from the residual solids. Another important factor is the ability to extract as much of the hydrocarbonaceous material as possible, i.e., a satisfactory yield.

One tar sand solvent-extraction process previously proposed involves mixing a solvent with the tar sand and then draining off the solvent and extracted hydrocarbons (bitumen). After being drained off, bitumen and solvent are then separated by fractionation. The bitumen is normally subjected to further conventional refining. After the bitumen and solvent have been drained from the solids, the solids are treated to remove any adhering solvent by steam stripping. Each extraction and drain stage can include countercurrent washing of the solids with solvent.

In U.S. Pat. No. 3,475,318, it is proposed to solvent-extract tar from tar sands using aliphatic hydrocarbons having 5 to 9 carbon atoms or mixtures of such aliphatics with up to 20% of aromatics having 6 to 9 carbon atoms. The tar sand is broken down into particles of a size between 0.03 and 0.25 inch diameter before solvent extraction. Solvent is passed over a bed of tar sand formed on a filter. The solid and tar are separated from the solvent residue by filtration. After filtration, the solids are stripped of volatiles with steam, which is employed at a rate of 3–21 pounds per 100 pounds of sand for a time of 0.5 to 3 minutes. Solvent is recovered by decantation from the subsequently condensed steam.

In U.S. Pat. Nos. 3,573,195 and 3,573,196 it is proposed to extract bitumen from bituminous sand by mixing the sand with water and hydrocarbon diluent containing dissolved normally gaseous ($C_1$–$C_3$) hydrocarbons, at a temperature of less than 40° F. and then introducing the resulting mixture into a body of water maintained at a temperature above 65° F. The normally gaseous hydrocarbons come out of solution and float the bitumen to the surface of the water for recovery. The hydrocarbon diluent is recovered by decantation from the water.

U.S. Pat. No. 3,875,046 discloses a solvent-extraction process using a single vertically extending extraction vessel. Downwardly flowing particulate tar sand is fluidized by an upwardly flowing liquid mixture of water and hydrocarbon solvent. The hydrocarbon solvent is selected to boil at a temperature below the boiling point of water. Steam is introduced into an intermediate level of the vessel to scour the solvent from the residual sand. Solvent is introduced above the steam introduction point, and water is introduced below the steam introduction point. Solvent condenses on the cooler sand higher up in the bed. The tar and hydrocarbon solvent are separated from water above the top of the tar sand bed by decantation and the solvent phase and water phase are removed. The water introduced into the lower end of the bed contains agglomerated fines. The wet, stripped sand is removed from the bottom of the vessel. The amount of hydrocarbon solvent employed is preferably that sufficient to control the viscosity of the tar recovered. The problem of solvent recovery is discussed. That is, this patent recognizes that a practical process for solvent extraction of hydrocarbon-containing solids necessarily must include some more-or-less effective means for recovering the organic solvent from the residual solids before the solids are discarded. The more solvent that is lost with the solid residues, the less economical will be a given solvent-extraction process.

The extraction of hydrocarbonaceous materials from coal and oil shale is known in the art. For example, U.S. Bureau of Mines Bulletin No. 635, entitled "Development of the Bureau of Mines Gas-Combustion Oil-Shale Retorting Process", by Arthur Matzick et al, refers on page 10 to the benzene-soluble material in oil shale, and refers on page 12 to the partial solubility of the organic material of oil shale in organic solvents. A textbook entitled "Chemistry of Coal Utilization", edited by H. H. Lowry, published by John Wiley & Sons, Inc., states on page 237, "Extraction of coal by solvents has been for many years a method used for studying the constitution of coal and for producing products of potential industrial value". Pages 239–240 refer to the extraction of low rank coal with primary aliphatic amines, and coal extraction with benzene, pyridine, phenols, aromatic hydrocarbons, aliphatic hydrocarbons, alcohols, ketones, etc. Page 243 states that ethylenediamine extracts material from coal at room temperature. The teachings of the two last-mentioned publications are incorporated herein by specific reference.

SUMMARY OF THE INVENTION

In an embodiment, the present invention concerns a method for solvent extracting an extractable component from a mixture including the extractable component and subdivided solids, comprising: (a) maintaining a vertically extending bed comprising the solids in a vertically extending extraction zone and introducing the mixture into an upper portion of the bed; (b) providing a substantially continuous gaseous phase in contact with a lower portion of the bed; (c) maintaining a substantially continuous liquid phase comprising a vaporizable liquid solvent in contact with at least a lower part of an upper portion of the bed; (d) introducing the solvent into the liquid phase at at least two vertically spaced levels of the liquid phase; (e) extracting the extractable component from the mixture with the solvent; (f) withdrawing the solvent and the extractable component from the liquid phase between the two vertically spaced levels; (g) preventing the liquid phase from flowing downwardly through the lower portion of the bed by maintaining the gaseous phase at a pressure sufficient to support the liquid phase thereon and vaporizing solvent adhering to solids in the lower portion of the bed; and (h) withdrawing solids from the lower portion of the bed.

As explained in my copending application, Ser. No. 909,890, filed on May 26, 1978, now U.S. Pat. No. 4,189,376 the complete disclosure of which is hereby incorporated in this specification, solvent extractable materials such as bitumen can be efficiently extracted from particulate solids in a single vessel with extremely small solvent losses in the residue. By (1) heating a lower portion of a bed of solids to strip solvent from the solids, and (2) maintaining a substantially continuous gaseous atmosphere in contact with the solids in the lower portion of the bed, a substantially continuous liquid solvent phase can be maintained above the gaseous phase, supported on the gaseous phase. Liquid solvent entering the gaseous phase adhering to solids is vaporized and stripped off the solids. Vaporized solvent returns to the liquid phase higher in the vessel and condenses. The bed of tar sand is either continuously moved downward or alternately held static and moved downward. As disclosed in Ser. No. 909,890, the solvent can be conveniently vaporized stripped off sand in the lower portion of the bed and a substantially continuous gaseous atmosphere can be maintained at the desired pressure by inroducing steam into the lower portion of the bed. When using steam as a vaporizing and stripping medium and as a gaseous-phase-forming medium, the solvent is preferably selected to have a boiling point below that of water at the pressure used.

According to the present invention, I have now found that the extent of recovery of a solvent extractable material such as bitumen may be enhanced by introducing solvent into the extraction bed at a plurality of vertically spaced levels of the liquid phase, and by removing at least part of the solvent and extracted material from the extraction zone between the levels of the liquid phase at which solvent is introduced. Preferably, one portion of the solvent and extracted material is removed from the extraction zone from at least one level of the liquid phase located at an intermediate level between two of the solvent inlet levels and another portion is removed from at least on other levels of the liquid phase located above the solvent inlets.

Further objects, embodiments and advantages of the present invention will be apparent from the following description of the drawing and detailed description of the invention.

THE DRAWING

The attached drawing shows a schematic side view of a solvent-extraction system employing a preferred embodiment of the present invention.

Referring to the drawing, there is shown a vertically extending solvent extraction zone such as a vessel or column 1, into an upper portion of which is fed an intimately associated mixture of an extractable material and subdivided solids, e.g., bituminous sand, by a conduit 3, connected to a supply hopper 5. The bituminous sand is conveyed from the hopper 5 into the vessel 1 by a screw-feed mechanism 6, located within the conduit 3 and driven by a motor 7. The feed mechanism may be operated continuously or intermittently. A vaporizable liquid solvent such as hexane is introduced into a vertically elongated portion 9 of the column 1 at three vertically spaced levels having solvent inlet means such as the inlet manifolds 11, 12 and 13, each of which is connected to a plurality of radially spaced inlets 15, 17 and 19 leading into the vessel 1. The upper end (indicated by a line at 20) of a bed (indicated generally at 21), comprising subdivided feed solids such as bituminous sand, is maintained above the level of the highest solvent inlet 15. The vessel 1 includes three larger-diameter clarifying sections 23, 24 and 25 disposed concentrically around narrower cylindrical sections 26, 27 and 28, which are open at their top and bottom ends to permit unimpeded downward movement of the bed 21 of solids. The clarification sections 23-25 facilitate separation of solvent and extract from any entrained fine solids before the liquid is removed from the clarifying sections through the outlets 29, 31 and 33. Steam is introduced into the column 1 through two manifolds 35 and 37, each having a plurality of radially spaced inlets 39 and 41. The steam manifolds are connected to a steam feed conduit 43. Stripped residual solids are removed from the bottom of the column 1 through a conduit 45. The residual solids are conveyed from the column by a screw conveyor 47 which is driven by a motor 49. The conveyor 47 may be operated continuously or intermittently. A substantially continuous gaseous phase designated generally by the number 51 is maintained in contact with a lower portion of the bed 21 below the lowest solvent inlet 19. A substantially continuous liquid phase, designated generally by the number 53, is maintained in contact with an upper portion of the bed 21 above the gaseous phase 51, with the liquid phase being supported on the gaseous phase. A liquid-gas interface between the liquid phase 53 and the gaseous phase 51 at an intermediate level of the solids bed is indicated by a line at 55.

DETAILED DESCRIPTION OF THE INVENTION

In general, the present solvent-extraction method is useful for recovering solvent-extractable components associated with subdivided, substantially non-extractable solids. The solubility, in any solvent, of any particular extractable component which it is desired to separate from intimate association with subdivided solids will, of course, depend on the particular solvent, or mixture of solvents, used. In operation of the present method it is required that the solvent be vaporizable and capable of extracting at least a portion, e.g., at least one weight percent, of the extractable component from a mixture including the extractable component and the subdivided solids. Taking these restrictions into account, it will be within the ability of those skilled in the art to select an appropriate solvent or solvent mixture for extracting a particular extractable component to separate it from association with non-extractable subdivided solids. When a material to be subjected to extraction is not found in a desired size range, the desired size range may be obtained, if necessary, by conventional grinding, milling, crushing or like procedure. Conventional, solvent extraction typically involves recovering a solvent-extractable organic component from intimate association with insoluble organic or inorganic subdivided solids. An organic solvent is often employed. The choice of solvent is normally made to optimize recovery of the particular desired extractable organic component.

Examples of mixtures of a solvent-extractable component intimtely associated with subdivided solids are seeds such as cottonseed, soybeans, flax seed, etc., in which the cottonseed oil, soy oil and linseed oil are the extractable components, with the subdivided solids being composed primarily of organic cellulosic material.

According to a preferred embodiment, the present method is particularly adapted for use in solvent extracting extractable hydrocarbonaceous components, e.g., bitumen, referred to generally herein as "hydrocarbons", from tar sands (bituminous sands), oil shale, coal, lignite, and the like, which contain a mixture of extractable hydrocarbonaceous components and subdivided, insoluble, inorganic solids. The present method is particularly adapted for use in extracting extractable liquid or liquefiable hydrocarbonaceous materials, normally termed "tar" or "bitumen", from the naturally occurring mixtures of tar, or bitumen, and inorganic solids such as sand, silt and clay, known as tar sands or bituminous sands. Deposits of such hydrocarbonaceous sands are found at several locations in the United States, Canada and other regions. The extractable component in bituminous sand, as will be readily appreciated by those skilled in the art, often includes oxygenated, nitrogenated, and other hetero-substituted organic compounds, metal chelates and the like, in addition to compounds which can be strictly classified as hydrocarbons.

The method of the invention may most conveniently be carried out in any type of vertically extending confined space, such as an extraction zone or vessel formed by a vertical pipe, conduit, chamber, etc. Generally, any type of conduit or chamber is suitable, providing that it is adapted to hold a vertically extending bed of the material to be solvent extracted and is adapted to contain the liquid solvent and a heated gaseous atmosphere at temperatures and pressures employed. A variety of conduits, chambers, reactors and the like which are suitable for use to provide an extraction zone or vessel employed in the present extraction method will be readily apparent to those skilled in the art.

In carrying out the method of the invention, a mixture of non-extractable subdivided solids and a solvent-extractable component in intimate association is passed into the upper portion of the extraction zone, and a bed comprising the non-extractable solids is maintained in the extraction zone. Preferably the solids are maintained in the extraction zone as a packed bed. Thus, solids higher up in the bed are preferably at least partially supported by solids lower in the bed, rather than solids being ebullated or fluidized by liquid or gaseous materials in the extraction zone. In one mode of operation, the bed is preferably maintained with particles substantially continuously moving downwardly through the extraction zone. In this mode, the particles preferably move downwardly in substantially plug flow. It will be appreciated that in a bed with a relatively large horizontal cross-sectional area, different portions of the bed may be moving downwardly at somewhat different rates, even when a packed bed is used. Materials to be solvent extracted may be introduced into the bed and residual solids may be removed from the bed, continuously or periodically or at any convenient time, in any convenient manner, e.g., by a screw conveyor, star feeder, rotating grate, etc. Preferably, when residual solids are removed from the bed, they are removed relatively uniformly from a complete cross-section of the bed, so that plug-type flow of solids downwardly through the vertical extraction zone is facilitated. Plug-type solids flow using a packed bed of solids is particularly advantageous in the present method, in that fewer fine solids are entrained in the moving liquid solvent and extracted material. It will be understood that, while the bed comprises primarily the non-extractable solids, the bed may also include unextracted fractions of the extractable component. This is particularly so closer to the upper end of the bed, and in cases where the extractable component is solid or semisolid prior to extraction.

In another mode of operation, the bed is preferably alternately moved downwardly and held substantially static. The length of time the bed is held static and the length of time the bed moves downward in the alternating moving-static mode can be varied to permit optimum extraction of the extractable component in the liquid phase and to permit optimum removal of solvent liquids from the residual solids in the gas phase. Preferably, the alternating of downward movement and holding stationary can be carried out in a periodic manner, but such is not necessary. In some cases, the pressure of the gas phase is sufficient to impede or halt the downward movement of the bed. In such cases, the pressure can be alternately increased and decreased, with the bed moving downward during the lower pressure periods and remaining static during the higher pressure periods. In the higher-lower pressure mode, the interface between the gas phase and the liquid phase can be made to move higherin the bed during the higher pressure, stationary bed periods, and when the pressure is decreased and the bed moves downward, then the interface between the gas phase and the liquid phase also moves downward, in some cases at a faster rate than the bed. In embodiments using steam to provide the gas phase, the flow of steam can be alternately increased and decreased or alternately turned on and off, whereby the movement of the bed and the vertical level of the gas-liquid interface can be controlled.

According to the present invention, a vaporizable liquid solvent is introduced into a liquid phase in an upper portion of the bed of solids at two or more vertically spaced levels of the liquid phase. The lowest vertical level at which solvent is introduced must be sufficiently spaced from the bottom of the bed to provide space for formation of a gaseous phase below that solvent introduction level and to allow space sufficient for vaporization and separation of any adhering solvent from the solids below the lowest solvent inlet. The solvent inlets should also be adequately spaced from the liquids outlet or outlets for effective contact between the solvent and solids in the upper portion of the bed to provide good extraction.

The best solvent for use in any particular case can be selected by one skilled in the art according to the type of extractable component to be extracted in the given case. The solvent must be vaporizable to permit its use and should have a normal boiling point below at most 275° C., and preferably below 100° C. Representative of generally suitable solvents are: hydrocarbons, including, for example, $C_4$–$C_{10}$ or higher aliphatics such as pentanes, hexanes, heptanes, octanes, olefins and cyclo-olefins such as methylcyclopentene, naphthenes such as cyclopentane, cyclohexane, alkylcyclohexanes, as well as $C_6$–$C_{10}$ or higher aromatics such as benzene, toluene, xylenes, ethylbenzene, $C_4$-275° C. boiling petroleum fractions such as naphthas, gasoline fractions, etc., especially $C_4$-95° C. fractions, $C_4$-275° C. or higher-boiling synthetic hydrocarbon fractions such as may be derived from pyrolysis, gasification, liquefaction or extraction of tar sand, coal, oil shale and the like, especially $C_4$-95° C. fractions, halogen-substituted hydrocarbons such as carbon tetrachloride, chloroform, trichlorofluoromethane, ethyl chloride, ethylene dichloride, methylene chloride, perchloroethylene, trichloroethylene; alcohols such as methanol, ethanol, isopropanol, butanol, pentanol, hexanol, etc., phenol, alkylphenols; esters such as methyl acetate, ethyl acetate isopropyl acetate, butyl acetate, vinyl acetate; ketones such as acetone, methyl ethyl ketone; ethers such as tetrahydrofuran; carbon disulfide, dimethylformamide; polyols, glycol ethers, etc.

It is especially to be noted that mixtures of two or more of the solvents or classes of solvents discussed above are often suitable for use in the present method. For example, mixtures of aromatic and aliphatic hydrocarbons, or mixtures of alcohols with hydrocarbons, such as phenol-benezene mixtures, are quite suitable. It is also to be stressed that different solvents can be introduced at different vertical levels of the liquid phase, if desired. That is, the scope of the invention includes cases where plural solvents are separately introduced.

For example, in the embodiment shown in the attached drawing, a light, vaporizable solvent can be introduced into the column through the lowest inlets 19 or through the lower two sets of inlets 19 and 17, while a heavier solvent, which need not be vaporizable, can be introduced through the highest inlets 15, or through the higher two sets of inlets 15 and 17. In this sort of embodiment, a mixture of bitumen, lighter solvent and heavier solvent can be removed from the extraction zone from between the levels at which the lighter and heavier solvents are introduced.

Surface-active agents, whether termed "surfactants", "wetting agents", etc., can be employed in the present method. For example, a surfactant can be mixed with the solvent to enhance the solvent properties or to enhance removal of organic liquids from pores of nonextracted solids. Suitable surface-active agents can be, for example, inorganic hydroxide salts, carboxylic acids, sulfuric esters, alkane sulfonic acids and salts, alkylaromatic sulfonic acids and salts, organic and inorganic ammonium salts, alkali metal silicates, phosphoric acids and salts, amine salts, and the like. Specific examples of suitable surface-active agents are sodium laural sulfate, polyoxyethylene alkylphenols, dodecyl trimethyl ammonium chloride, alkylaryl naphthenic sulfonate, tetrasodium pyrophosphate, sodium tripolyphosphate, potassium pyrophosphate and sodium silicate, sodium carbonate, alkali metal hydroxides, and alkaline earth metal hydroxides.

Emulsion-breaking components may also be used in the system, as by combining them with the solvent in an effective amount. Examples of suitable de-emulsifiers include polyethoxyalkylane, diethyl ethanolamine, polyols, and polyoxypropylene glycols.

Solvents which are insoluble (or immiscible) or only slightly soluble (or only slightly miscible) in water are preferred. Preferably the solvent used has a normal boiling point or normal end boiling point below the normal boiling point of water. For example, hexane and cyclohexane are very suitable as to boiling point. In one preferred embodiment, the normal boiling point or normal end boiling point of the solvent is at least 15° C. below the normal boiling point of water. Preferably the solvent employed has a specific gravity of less than 1.0.

In a preferred embodiment of the present invention for solvent extraction treatment of tar sands and the like, preferred solvents include pentanes, hexanes, benzene, cyclopentane, cyclohexane and methyl cyclopentane, and olefins and cycloolefins, and particularly mixtures of two or more of the above in any proportions. Hydrocarbon fractions having a boiling range between about 35° C. and about 95° C., such as petroleum fractions available in petroleum refineries, or hydrocarbon fractions derived from coal, tar sand oil, etc., are particularly preferred solvents. A suitable solvent may, in many cases, be provided in whole or in part from extracted hydrocarbons obtained in the present extraction operation from tar sands or the like. A suitable solvent material may, for example, be obtained by distillation or fractionation, catalytic cracking, hydrocracking, coking and/or other conventional refining or conversion treatment of the extracted material. Such solvents may, of course, be enhanced by the addition of other solvent-type materials such as phenol.

Further according to the invention, solvent and extracted bitumen are removed from the extraction zone at a level of the liquid phase located intermediate between the highest and lowest levels at which solvent is introduced. Preferably, part of the extracted bitumen and rich solvent is removed from the liquid phase above the highest level at which solvent is introduced, and one or more other portions of rich solvent and extracted bitumen are removed from at least one intermediate level between the highest and lowest levels at which solvent is inroduced. One of the advantages in withdrawing at least part of the mixture of rich solvent and extracted bitumen from an intermediate level is that a larger amount of solvent can be introduced into the extraction zone, relative to a system in which all the extracted bitumen and rich solvent are removed from the liquid phase at a level above the highest solvent inlet, while avoiding an undesirably high liquid velocity within the bed of solids in the extraction zone. An overly rapid liquid flow rate through the solids bed may cause entrainment of solid particles in the mixture of bitumen and solvent or may result in undesirable fluidization or ebullation of solids. On the other hand, using a relatively small amount of solvent and operating with low solvent flow rates and solvent/bitumen ratios can result in inefficient extraction of bitumen. By removing solvent and bitumen from an intermediate level, relative to the levels at which solvent is introduced, the overall amount of solvent introduced and solvent/bitumen ratio can be maintained at advantageously high levels without entrainment of solids and without disruption of the solids bed.

Solvent is introduced into at least two vertically spaced levels in the upper portion of the bed in the extraction zone in contact with the liquid phase. Preferably, solvent is introduced into at least three vertically spaced levels. Solvent and extracted bitumen are recovered from the liquid phase at one or more levels vertically intermediate between the highest and lowest levels at which solvent is introduced. Preferably, solvent and extracted bitumen are removed from at least two intermediate levels. Particularly preferably, solvent is introduced at three or more vertically spaced levels, and a mixture of solvent and bitumen is withdrawn from the extraction zone from a level located between each solvent introduction level, and also from a level of the liquid phase above the highest solvent inlet.

The relative amounts of solvent introduced into each vertically spaced inlet and the relative amounts of the solventbitumen mixture removed at each intermediate outlet will depend on the particular material to be solvent extracted, the solvent or solvents used, and the operating conditions such as temperature.

The invention can best be further described by reference to the drawing, which depicts a system for carrying out a preferred embodiment of the invention. It is to be noted that the scope of the invention is not limited to the embodiment shown. The scope of the invention includes the alternatives, modifications and equivalents of the depicted embodiment which will be apparent to those skilled in the art.

Referring to the drawing, fresh bituminous sand is introduced, either continuously or at regular or varying intervals, into the solvent extraction zone in the vessel 1 into the confined space provided by the vertically elongated section 9, by way of the conduit 3. Expended, residual sand is removed from the bottom of the section 9 through the conduit 45 either continuously or at intervals corresponding generally with the introduction of fresh tar sand. A bed of solid tar sand is maintained in the vessel 1, with the top end of the bed preferably kept at a level at about 20, sufficient fresh sand being supplied from the conduit 3 to compensate for the amount of residual sand removed by the conduit 45.

Bituminous sand is preferably introduced into the extraction system as particulate solids having a maximum average particle diameter of less than one-fourth inch. Of course, larger clumps of some bituminous sands will rapidly break down into particles of the desired small size when they contact the solvent, so that prior comminution is often not necessary. Preferably the bituminous sand is introduced with a particle size range of between 4 and 100 mesh, especially 4 to 20 mesh (Tyler Sieve Series), and particularly preferably the bituminous sand is introduced with a particle size range of about 4 to 10 mesh. The bed either continuously moves downwardly in the column or alternately moves and remains stationary. Preferably the bed is a lightly packed bed (i.e., a loosely packed bed), in which solids, when they move downwardly, do so in substantially plug flow at a rate of about 0.01 to about 1.0 foot per minute.

A lean vaporizable solvent, boiling between 35° C. and 95° C., such as organic liquids derived from processing of bitumen by coking in a conventional manner is introduced, preferably as a liquid, into the bed at a plurality of vertically spaced levels through the manifolds 11, 12 and 13 and inlets 15, 17 and 19. Somewhat below the lowest solvent inlet 19, the lower portion of the bed is heated above the boiling point of the solvent and a substantially continuous gaseous phase is maintained in contact with a lower portion of the bed. That is, the gaseous phase substantially completely fills the interstitial spaces in the gaseous-phase region of the lower portion of the bed and is in contact with substantially all the solids in the gaseous-phase region of the lower portion of the bed. The solids in the lower portion of the bed can be heated by direct or indirect contact with a heating medium, and the substantially continuous gaseous atmosphere can be supplied by any suitable gas, such as nitrogen or steam. The gaseous phase preferably extends entirely across a horizontal cross-section of the extraction zone. That is, there is at least one complete horizontal cross-section in the lower portion of the extraction zone through which substantially no liquid solvent passes downwardly, with the interstices between solids in the bed being substantially completely gaseous. Preferably both the bed-heating requirement and provision of a gaseous phase in the extraction zone are accomplished by introducing steam into the extraction zone below the solvent inlet by way of the steam conduit 43, the steam manifolds 35 and 37 and steam inlets 39 and 41. The steam is introduced at a temperature, rate and pressure sufficient to maintain a substantially continuous gaseous phase in contact with the lower portion of the bed and to support upon the gaseous phase a substantially continuous liquid phase comprising the solvent, which is in contact with the upper portion of the bed above the gaseous phase. Steam is provided at a temperature and pressure sufficient to maintain a liquid-gas interface, e.g., as depicted in the drawing by a line at 55. Above the interface at 55, a substantially continuous liquid phase 53 is in contact with the bed, whereas below the interface at 55 a gaseous phase 51, comprising steam but generally including some solvent vapor, is in contact with the bed. The interstices of the solids in at least a lower part of the upper portion of the bed are substantially filled with liquid, so that the liquid phase is substantially continuous in the portion of the extraction zone holding any of the upper portion of the bed which is in contact with the solvent-containing liquid phase 53. Any liquid solvent which wets or is absorbed by the solids in the bed, when they pass below the interface at 55 is vaporized rapidly. Solvent vapor in the gaseous phase is preferably returned upwardly to the liquid phase, giving off the latent heat to solids entering the gaseous phase and condensing back into the liquid phase. The amount of steam introduced need only be enough to heat the solids in the lower portion of the bed enough to vaporize solvent adhering to the solids and to support the liquid phase above the interface. The steam introduced may all condense to liquid water by the time it is removed from the system. Any liquid water which is present below the gaseous phase 51 may be kept substantially free from solvent, since any water below the gaseous phase is preferably maintained at a temperature above the boiling point of the solvent, while the solvent may be prevented from mixing with any water below the gaseous phase if a solvent substantially immiscible with the water is used. In cases where a solvent is used which is soluble or partly soluble in water, any liquid water below the gaseous phase 51 may contain a substantial amount of solvent. Usually, the amount of liquid water formed by condensation of steam below the gaseous phase is not enough to completely fill the void spaces between the solids in the bed. Accordingly, the portion of the bed below the gaseous phase may be partially in contact with liquid water and partially in contact with steam. In this case, a mixture of steam and liquid water is withdrawn along with the residual solids. Any solvent vapor mixed with this steam can then be recovered by condensing all the steam and solvent and separating the solvent from the condensate by decantation. Alternatively, the amount of heat introduced may be sufficient that substantially no water condenses in contact with the lower portion of the bed below the interface 55, and any water removed from the bed with the residual solids is in the form of steam. In this case, some solvent vapor is usually mixed with the steam and residual solids. The steam and solvent vapor may be condensed and any solvent can then be separated from the condensate by decantation.

In any case, it will be appreciated that a liquid, substantially continuous water-rich phase region may, in some cases, be present in contact with a bottom part of the lower portion of the bed below the gaseous phase region. Preferably, however, the gaseous phase is in contact with substantially all the solids in the lower portion of the bed, i.e., below the liquid, solvent-rich phase.

The extractable tar or bitumen is extracted from tar sand in the upper portion of the bed in contact with the liquid phase above the interface at 55 by passing the liquid hexane solvent through the upper portion of the bed between the solvent inlets and the solvent-bitumen outlets. The solvent is preferably introduced into the column through each inlet a rate low enough that the solids in the bed which are in contact with the liquid solvent phase are not substantially fluidized. In this way, the bed itself acts as a filter for solid fines.

In cases where the solids to be treated may be lighter than the solvent used, as in extraction of oils from light cellulosic material, the top of the bed of solids can conveniently be maintained above the top of the liquid solvent phase in the extraction zone. In this way, a portion of the bed can be maintained submerged in the solvent phase by the pressure of solvent-free solids from above. Thus, it is not critical that the solvent-containing liquid phase extend above the top 20 of the bed of solids. In embodiments in which tar sand or other solids heavier than the solvent are to be extracted, it may, in some cases, be desirable to maintain the top of the liquid solvent phase above the top of the bed of solids. Liquid containing a mixture of solvent and bitumen is removed from the column from the three enlarged clarifying sections 23, 24 and 25 through the outlets 29, 31 and 33. The solvent may then be separated from the bitumen in a conventional manner and recycled, if desired, and the bitumen may be further processed or refined, if desired, as by coking, hydrocracking, fluid catalytic cracking or other known processes. The temperatures and pressures used in the present extraction method are not critical, except that the upper, liquid phase and the lower, gaseous phase must be maintained. The solvent and the mixture to be solvent extracted may be at ambient temperature and pressure prior to their introduction into the extraction vessel, or may be heated.

The extracted, residual solids, having passed downwardly through the extraction zone, into the gaseous phase, are then removed from the bottom portion of the solids bed. Preferably the solids are removed from a complete cross-section of the bottom end of the bed at a relatively uniform rate, so that plug-type downward flow of the bed downward through the extraction zone is maintained during solids removal.

A preferred embodiment of the present invention having been described, a large number of modifications and equivalents of the preferred embodiment will be apparent to those skilled in the art, and the scope of the invention is to be determined by the appended claims.

What is claimed is:

1. A method for solvent extracting an extractable component from a mixture including said extractable component and subdivided solids, comprising:

(a) maintaining a vertically extending downwardly moving packed bed comprising said solids in a vertically extending extraction zone and introducing said mixture into an upper portion of said bed;

(b) providing a substantially continuous gaseous phase in contact with a lower portion of said bed;

(c) maintaining a substantially continuous liquid phase comprising a vaporizable liquid solvent in contact with at least a lower part of an upper portion of said bed;

(d) introducing said solvent into said liquid phase at at least two vertically spaced levels of said liquid phase;

(e) extracting said extractable component from said mixture with said solvent;

(f) withdrawing said solvent and said extractable component from said liquid phase between said two vertically spaced levels;

(g) preventing said liquid phase from flowing downwardly through said lower portion of said bed by maintaining said gaseous phase at a pressure sufficient to support said liquid phase thereon and vaporizing solvent adhering to solids in said lower portion of said bed; and (h) withdrawing solids from said lower portion of said bed.

2. A method according to claim 1 further including the step of withdrawing said solvent and said extractable component from said liquid phase above said two vertically spaced levels.

3. A method according to claim 1 wherein said solids in said lower portion of said bed are heated to a temperature above the boiling point of said solvent, said gaseous phase is provided by introducing steam into said lower portion of said bed, and said gaseous phase comprises steam.

4. A method according to claim 1 wherein said bed is substantially continuously moving downward in said zone.

5. A method for solvent extracting bitumen from bituminous sand comprising:

(a) maintaining a vertically extending downwardly moving packed bed comprising bituminous sand in a vertically extending extraction zone and introducing bituminous sand into an upper portion of said bed;

(b) providing a substantially continuous gaseous phase in contact with a lower portion of said bed;

(c) maintaining a substantially continuous liquid phase comprising a vaporizable liquid solvent in contact with at least a lower part of an upper portion of said bed;

(d) introducing said solvent into said liquid phase at at least two vertically spaced levels of said liquid phase;

(e) extracting bitumen from said bituminous sand with said solvent;

(f) withdrawing said solvent and bitumen from said liquid phase between said two vertically spaced levels;

(g) preventing said liquid phase from flowing downwardly through said lower portion of said bed by maintaining said gaseous phase at a pressure sufficient to support said liquid phase thereon and vaporizing solvent adhering to solids in said lower portion of said bed; and (h) withdrawing solids from said lower portion of said bed.

6. A method according to claim 5 wherein said solvent comprises at least one hydrocarbon having a boiling point within the range from 35° C. to 275° C.

7. A method according to claim 5 wherein solids in said lower portion of said bed are heated to a temperature above the boiling point of said solvent, said gaseous phase is provided by introducing steam into said lower portion of said bed, and said gaseous phase comprises steam.

8. A method according to claim 5 further including the step of withdrawing solvent and bitumen from said liquid phase above said two vertically spaced levels.

* * * * *